United States Patent [19]

Katona

[11] 4,049,939

[45] Sept. 20, 1977

[54] MICROWAVE AND RADIANT WINDOW FOR OVEN DOORS

[75] Inventor: Joseph W. Katona, Walled Lake, Mich.

[73] Assignee: Mills Products, Inc., Farmington, Mich.

[21] Appl. No.: 681,456

[22] Filed: Apr. 29, 1976

[51] Int. Cl.[2] ..... H05B 9/06

[52] U.S. Cl. ..... 219/10.55 D; 174/35 MS

[58] Field of Search ..... 219/10.55 D, 10.55 R, 219/10.55 F; 126/273 R; 174/35 R, 35 MS

[56] References Cited

U.S. PATENT DOCUMENTS

| | | | |
|---|---|---|---|
| 2,958,754 | 11/1960 | Hahn | 219/10.55 D |
| 3,177,334 | 4/1965 | Kinkle | 219/10.55 D |
| 3,304,401 | 2/1967 | Long | 219/10.55 D |
| 3,430,023 | 2/1969 | Tingley | 219/10.55 D |
| 3,809,843 | 5/1974 | Takayama | 219/10.55 D |
| 3,879,595 | 4/1975 | Lamb | 219/10.55 D |
| 3,885,084 | 5/1975 | Kaiserwerth et al. | 174/33 MS |
| 4,000,390 | 12/1976 | Graff | 219/10.55 D |
| 4,008,383 | 2/1977 | Tanaka et al. | 219/10.55 D |
| 4,010,343 | 3/1977 | Tanaka et al. | 219/10.55 D |

*Primary Examiner*—Arthur T. Grimley
*Attorney, Agent, or Firm*—Whittemore, Hulbert & Belknap

[57] ABSTRACT

A self-contained window unit adapted to be assembled into an oven door, comprising a pair of glass panes and a microwave shield. The glass panes are held in spaced parallel relation by a frame of electrically conducting material which has a peripheral mounting flange in electrical contact with the edge of the microwave shield. Fasteners around the four sides of the window unit secure the mounting flange to the door to both mount the window unit and ground the microwave shield.

12 Claims, 5 Drawing Figures

MICROWAVE AND RADIANT WINDOW FOR OVEN DOORS

SUMMARY OF THE INVENTION

The window in a microwave oven door needs to be shielded to prevent harmful radiation from escaping. It is among the objects of this invention to provide an improved means for mounting and grounding the microwave shield. In the constructions about to be described, a pair of glass panes are held in spaced parallel relation by a mounting frame which has an integral mounting flange extending about the four sides of the window unit. A microwave shield beteween the glass panes has its peripheral edge portion in substantially continuous electrical contact with the mounting flange. Fasteners along the four sides of the window unit secure the mounting flange and the peripheral portion of the microwave shield to brackets on one of the door panels to both mount the window unit and ground the microwave shield. The unit thus provides a built-in mounting flange and the shield is grounded at several points along the four sides of the window unit to completely dissipate any microwave radiation.

Further in accordance with the invention, it is an object of the invention to provide an arrangement in which the fasteners for securing the mounting flange of the frame to the door tighten the frame against the glass panes.

Other objects and features of the invention will become more apparent as the description proceeds, especially when taken in conjunction with the accompanying drawings wherein.

Figure 1:
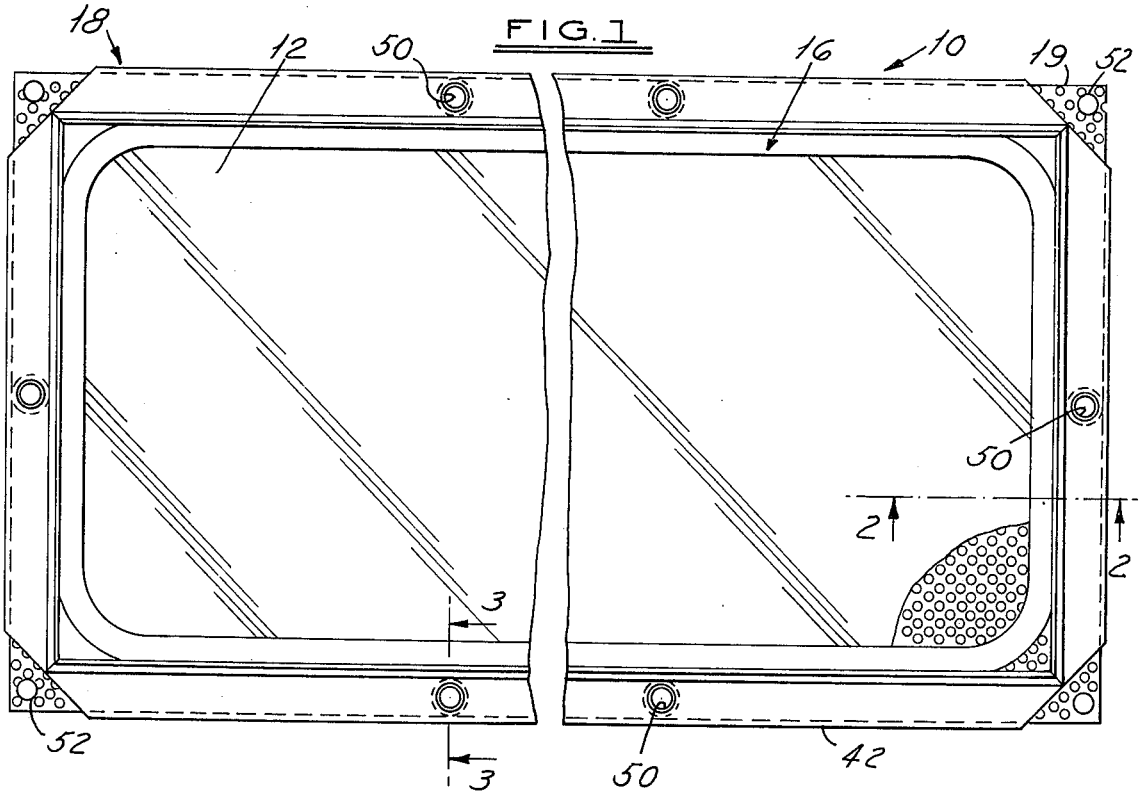
FIG. 1 is a plan view of a window unit constructed in accordance with my invention.

Referring now more particularly to the drawings, the self-contained window unit 10 comprises a pair of rectangular glass panes 12 and 14 maintained in spaced parallel relationship by a spacer 16 and a clamping frame 18.

A rectangular microwave shield 19 parallel to and between glass panes 12 and 14 is disposed in surface-to-surface contact with the inner face of the pane 14. The shield is formed of electrically conducting metal and has numerous perforations of a size to prevent microwave radiation from passing through but large enough to permit the oven chamber to be viewed from the outside.

The spacer 16 is a rectangular member of channel cross section having radially outwardly turned flanges 20 and 22 in contact with the inner peripheral surfaces of the glass pane 12 and the shield 19.

The clamping frame 18 is a rectangular member formed of electrically conducting metal. The clamping frame is generally channel shaped in cross section having a base 24 extending across the space between the glass panes and having laterally inwardly extending retaining flanges 26 and 28 engaging the outer peripheral surfaces of the glass panes. Specifically, each flange 26, 28 has a portion 30 which extends from the base 24 at right angles thereto and parallel to the outer surface of the adjacent glass pane, and a generally U-shaped terminal portion 32 which opens inwardly toward the outer surface of the adjacent glass pane and has an edge 34 in pressure contact with such surface. A strip of asbestos tape 36 lines the inner surface of the base 24 as well as the inner surfaces of the retaining flanges 26 and 28.

The base of the clamping frame on each of the four sides thereof is divided into front and rear portions 38 and 40 by an integral generally U-shaped section 42 which extends laterally outwardly beyond the base 24 and constitutes a mounting flange. This mounting flange 42 extends continuously along the top and bottom edges and the side edges of the window unit, being interrupted only at the corners as will be seen in FIG. 1. The reason for the corner interruptions is that the mounting frame is initially made of a length of stock which is bent into rectangular shape.

Figure 2:
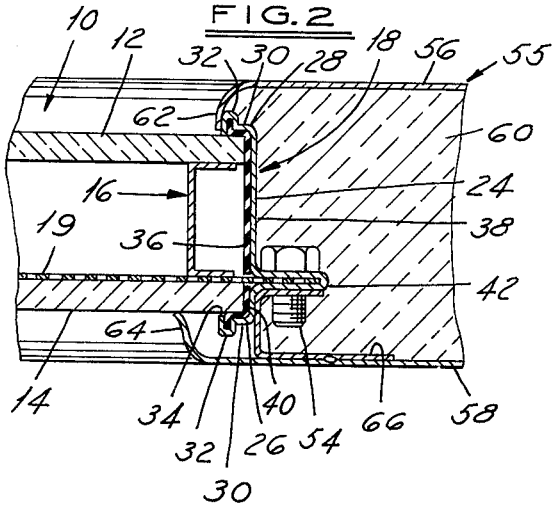
FIG. 2 is a sectional view taken on the line 2—2 in FIG. 1, showing the window unit mounted in an oven door.
Figure 3:
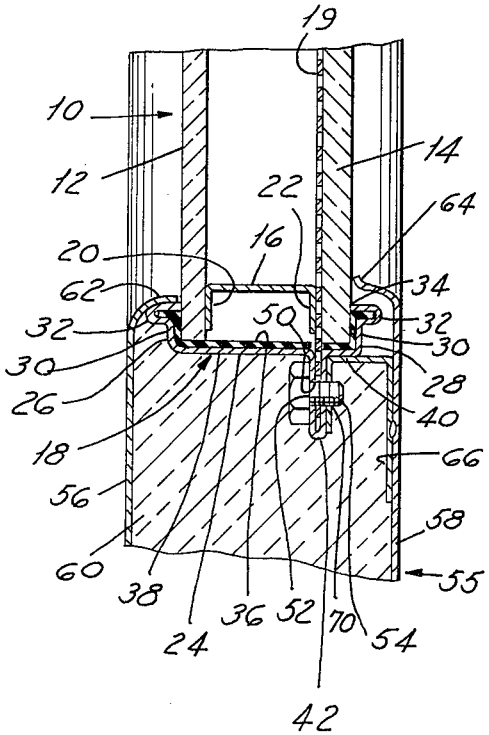
FIG. 3 is a sectional view taken on the line 3—3 in FIG. 1, likewise showing the window unit in an oven door.

The microwave shield 19 is both wider and longer than the glass panes 12 and 14 so that it extends outward beyond the peripheries of the glass panes along all four sides. Thus the peripheral portions of the microwave shield along the top, bottom and side edges project into the U-shaped section 42 defining the mounting flange. The shield cuts through the asbestos tape as seen in FIGS. 2 and 3. The four corners of the shield can be seen as exposed in FIG. 1 where the mounting flange is interrupted.

The top, bottom and side portions of the mounting flange 42 are formed with apertures 50 which extend through both parts of the U-shaped section. The top, bottom and side peripheral edge portions of the microwave shield received in the mounting flange are formed with apertures 52 which register with the apertures 50 in the mounting flange. Additional apertures 52 are shown in FIG. 1 at the four corners of the microwave shield. These apertures 50 and 52 are for receiving mounting bolts 54.

FIGS. 2 and 3 show the window unit installed in an oven door 55 which has a front door panel 56 and a back door panel 58 with insulating material 60 therebetween. The door panels are of electrically conducting metal. The front panel 56 has an annular rearwardly turned flange 62 and the rear panel 58 has an annular forwardly turned flange 64. The flanges 62 and 64 define registering apertures constituting the opening of the oven door in which the window unit 10 is installed.

The window unit is mounted in the door within the opening thereof by means of bolts 54 and a plurality of generally U-shaped brackets 66. These bolts 54 and brackets 66 are formed of electrically conducting metal. Each bracket 66 has one leg welded or otherwise permanently secured in surface-to-surface electrical contact to the inner surface of the rear door panel 58. The other leg is in full surface contact with the mounting flange 42 as clearly seen in FIGS. 2 and 3 and has a threaded aperture 70. These brackets 66 are arranged around the four sides of the window opening in the oven door in positions to receive the mounting bolts 54 which extend through the apertures 50 and 52 in the mounting flange 42 and in the microwave shield 19. FIGS. 2 and 3 show the mounting bolts 54 extending through such apertures 50 and 52 and threading into the apertures 70 in the brackets 66 to securely mount the window unit to the rear panel of the oven door. The bolt head bears in electrical contact against one side of the mounting flange 42 and clamps the mounting flange in electrical contact with the microwave shield 19 and against the apertured leg of bracket 66.

It will be understood that before the mounting bolts 54 are applied the width of the space within the U-shaped mounting flange 42 is greater than the thickness of the microwave shield. Accordingly, when the bolts 54 are tightened to draw the head of each bolt toward the apertured leg of a bracket 66, the U-shaped mounting flange 42 is compressed into tight electrical contact with both sides of the peripheral portion of the microwave shield, at the same time drawing the flanges 26 and 28 of the clamping frame 18 toward one another to force the edges 34 thereof tight against the outer surfaces of the glass panes. This provides a substantially rattle-proof assembly. The edges of the glass panes as well as the outer peripheral surfaces thereof are contacted by the asbestos tape 36 to cushion the assembly thereby stopping breakage, and also forming a seal to keep oven vapors from escaping.

In use, the mounting by the bolts 54 and brackets 66 to the mounting flange at points along each of the four sides of the window unit provides a secure mounting for the window unit and also grounds the microwave shield at each mounting point. Thus microwave radiation impinging upon the microwave shield at any point on its surface is immediately dissipated through the nearest mounting bolt and bracket to the back panel of the door.

Figure 4:
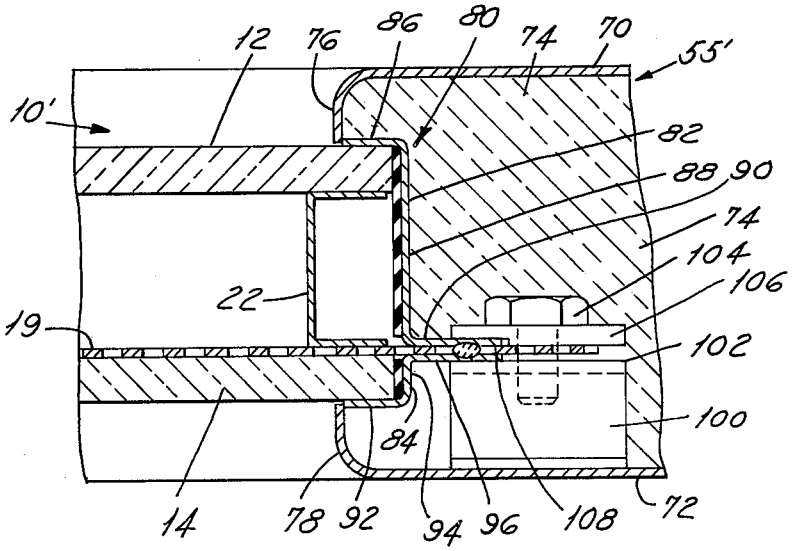
FIG. 4 is a fragmentary sectional view similar to FIG. 2 but showing a modification.

FIG. 4 illustrates a modification of the invention in which the window unit 10' differs from the window unit 10 only in the construction of the clamping frame. Window unit 10' has the parallel front and rear glass panes 12 and 14 as in the previous embodiment as well as the microwave shield 19 held against the inner surface of the rear glass pane 14 by the spacer 22. The oven door 55' in which the window unit 10' is mounted is of substantially the same construction as the oven door first described, having the front and rear panels 70 and 72 of electrically conducting metal and insulation 74 therebetween. The annular rearwardly turned flange 76 of the front panel and the annular rearwardly turned flange 78 of the rear panel 72 register to define the opening of the oven door in which the window unit 10' is installed.

The clamping frame 80 of the window unit 10' is somewhat different from the clamping frame 18 previously described. The clamping frame 80 is rectangular so as to extend around all four sides of the glass panes. It consists of two rectangular members 82 and 84 formed of electrically conducting metal each of Z-shaped cross section. The front member 82 has a laterally inwardly extending flange 86, a transverse intermediate web 88 and a laterally outwardly extending flange 90. The rear member 84 has a laterally inwardly extending flange 92, a transverse intermediate web 94 and a laterally outwardly extending flange 96. The flanges 86 and 92 and the webs 88 and 94 of the two members make up a channel configuration with the webs combining to form the base of the channel and extending across the space between the glass panes and the flanges 86 and 92 engaging the outer peripheral surfaces of the glass panes around the four sides thereof to clamp the glass panes and microwave shield 19 against the spacer 22. The laterally outwardly extending flanges 90 and 96 are welded in surface-to-surface electrically conducting relation to opposite sides of the peripheral portion of the microwave shield around the four sides thereof. Such two flanges 90 and 96 together form a mounting flange. The edge portion of the microwave shield 19 projects beyond the mounting flange and has apertures in such projecting edge portions along all four sides of the window unit.

Z-shaped mounting brackets 100 of electrically conducting metal are welded or otherwise permanently secured in electrical contact to the rear door panel 72 at spaced points corresponding to the apertures in the edge portions of the shield along the top, bottom and side edges of the window opening. It will be noted that one leg 102 of each Z-shaped bracket 100 provides a support surface for the laterally outwardly extending flange 96. This flange is secured down in electrical contact against the legs 102 by bolts 104 of electrically conducting metal which extend through the peripheral apertures in the projecting top, bottom and side edges of the microwave shield 19 and which thread into apertures in the legs 102. If desired, a washer 106 of electrically conducting metal may be clamped by the head of each bolt over the flange 90 and preferably such washer is relieved on the underside where indicated at 108 so that the washer may also contact the edge of the microwave shield. The mounting bolts 104 and brackets 100 mount the window unit at spaced points around the four sides of the window unit and also ground the microwave shield at such mounting points.

Figure 5:
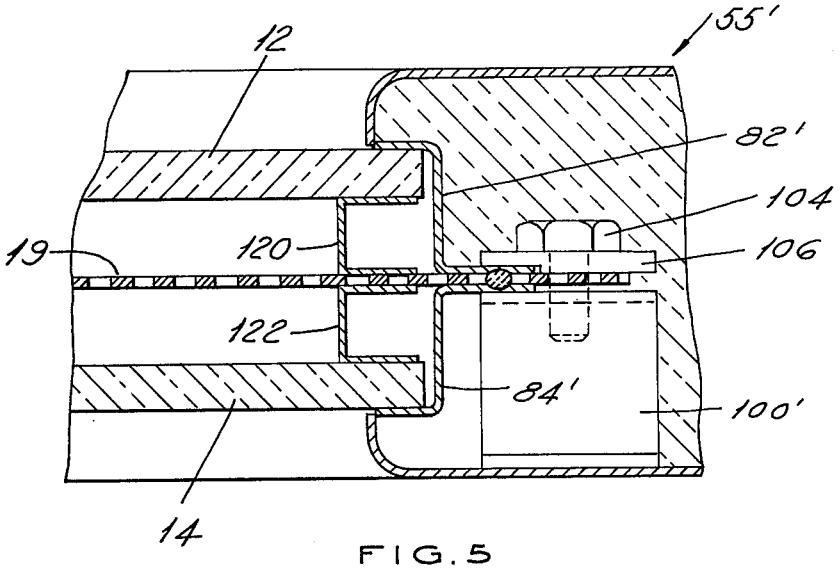
FIG. 5 is a fragmentary sectional view showing a further modification.

FIG. 5 differs from FIG. 4 in that the microwave shield 19 is held in spaced parallel relation midway between the glass panes 12 and 14 by a pair of rectangular channel-shaped spacers 120 and 122 which contact the peripheral portions of the inner surfaces of the glass panes and the opposite peripheral surfaces of the microwave shield around the four sides of the window unit. The Z-shaped members 82' and 84' are substantially the same as the Z-shaped members 82 and 84 except that the web 82' is shorter than the web 82 and the web 94' is longer than the web 94 to support the microwave shield in centered relation between the glass panes. The bolts 104 and washers 106 are the same as in FIG. 4 and the mounting brackets 100' differ from the mounting brackets 100 In FIG. 4 only in that they are somewhat larger in order to contact the mounting flange. Otherwise the FIG. 5 embodiment is like that of FIG. 4.

What I claim as my invention is:

1. A self-contained window unit adapted to be assembled into an oven door having front and rear panels provided with aligned window openings therein, comprising a pair of glass panes, means for holding said glass panes in spaced parallel relation, said holding means comprising a frame of electrically conducting material extending about the peripheries of said glass panes and having a mounting flange, a microwave shield of electrically-conducting material parallel to said glass panes and having an edge portion held in surface-to-surface electrical contact with said flange, and means for securing said flange to one of said door panels to both mount said window unit and ground said microwave shield.

2. The self-contained window unit defined in claim 1, wherein said mounting flange extends laterally outwardly beyond said glass panes about substantially the entire peripheries thereof, said edge portion of said microwave shield about substantially the entire periphery thereof being in electrical contact with said flange, and said securing means comprises metal fasteners provided at spaced points along the peripheral extent of said flange.

3. The self-contained window unit defined in claim 2, wherein said frame is generally channel-shaped in cross section having a base extending across the space between said glass panes and laterally inwardly extending retaining flanges engaging the outer peripheral surfaces thereof, said base being divided into front and rear portions by an integral generally U-shaped section extending laterally outwardly beyond said glass panes about substantially the entire periphery thereof and constituting said mounting flange, said microwave shield being disposed between said glass panes and the edge portion thereof extending into said U-shaped section, and said metal fasteners clamping said edge portion of said microwave shield within said U-shaped section.

4. The self-contained window unit defined in claim 3, wherein the width of the space within said U-shaped section in its free state condition is greater than the thickness of said shield, said fasteners compressing said U-shaped section into clamping engagement with the edge portion of said shield and also drawing said retaining flanges into pressure contact with the outer peripheral surfaces of said glass panes.

5. The self-contained window unit defined in claim 4, wherein said fasteners are provided at the sides and ends of said window unit.

6. The self-contained window unit defined in claim 5, wherein said securing means also includes brackets on said one door panel, said fasteners clamping said mounting flange to said brackets.

7. The self-contained window unit defined in claim 2, wherein said frame is composed of two members of generally Z-shaped cross section, each having a laterally inwardly extending flange, an intermediate web and a laterally outwardly extending flange, said laterally inwardly extending flanges engaging the outer peripheral surfaces of said glass panes, said webs being disposed in a plane extending across the space between said glass panes, said laterally outwardly extending flanges together constituting said mounting flange and extending parallel to one another in surface-to-surface electrical contact with the opposite sides of said edge portion of said microwave shield.

8. The self-contained window unit defined in claim 7, wherein said fasteners are provided at the sides and ends of said window unit.

9. The self-contained window unit defined in claim 8, wherein said securing means also includes brackets on said one door panel, said fasteners clamping said mounting flange to said brackets.

10. The self-contained window unit defined in claim 9, wherein said means for holding said glass panes in spaced parallel relation includes a spacer between said glass panes which also holds said microwave shield in contact with one of said glass panes.

11. The self-contained window unit defined in claim 9, wherein said means for holding said glass panes in spaced parallel relation includes spacers between said glass panes which also hold said microwave shield between and in spaced relation to said glass panes.

12. A self-contained window unit adapted to be assembled into an oven door having front and rear panels provided with aligned window openings therein, comprising a pair of glass panes, means for holding said glass panes in spaced parallel relation, said holding means comprising a frame of electrically conducting material extending about the peripheries of said glass panes and having a mounting flange, a microwave shield of electrically-conducting material parallel to said glass panes and having an edge portion overlying said mounting flange, and means for clamping said edge portion of said shield and said flange together and for securing said flange to one of said door panels to both mount said window unit and ground said microwave shield.

* * * * *